US008641335B2

(12) United States Patent
Takashima et al.

(10) Patent No.: US 8,641,335 B2
(45) Date of Patent: Feb. 4, 2014

(54) APPARATUS FOR FORMING MICROSCOPIC RECESSES ON A CYLINDRICAL BORE SURFACE AND METHOD OF FORMING THE MICROSCOPIC RECESSES ON THE CYLINDRICAL BORE SURFACE BY USING THE APPARATUS

(75) Inventors: Kazuhiko Takashima, Yokohama (JP); Yoshitaka Uehara, Yokohama (JP); Minoru Ota, Kanagawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 1980 days.

(21) Appl. No.: 11/481,258

(22) Filed: Jul. 6, 2006

(65) Prior Publication Data

US 2007/0010173 A1 Jan. 11, 2007

(30) Foreign Application Priority Data

Jul. 6, 2005 (JP) ..... 2005-197377
Apr. 27, 2006 (JP) ..... 2006-122831
Jun. 19, 2006 (JP) ..... 2006-169080

(51) Int. Cl.

| | |
|---|---|
| ***B23P 15/16*** | (2006.01) |
| ***B23Q 17/00*** | (2006.01) |
| ***B23B 51/00*** | (2006.01) |
| ***B23G 5/00*** | (2006.01) |
| ***B23D 77/00*** | (2006.01) |

(52) U.S. Cl.

USPC ..... 408/147; 29/407.05; 29/896.6; 408/150

(58) Field of Classification Search

USPC ..... 29/407.05, 90.01, 90.3, 90.7, 896.6; 408/147, 150, 173; 82/1.11, 1.2, 1.4, 82/1.5

See application file for complete search history.

(56) References Cited

U.S. PATENT DOCUMENTS

| | | | | |
|---|---|---|---|---|
| 4,869,127 | A * | 9/1989 | Ariyoshi | 475/1 |
| 5,828,136 | A * | 10/1998 | Yang | 290/4 A |
| 6,475,065 | B1 * | 11/2002 | Holmes | 451/28 |
| 6,520,834 | B1 * | 2/2003 | Marshall | 451/5 |
| 6,585,567 | B1 * | 7/2003 | Black et al. | 451/36 |
| 6,976,419 | B1 | 12/2005 | Miyamoto et al. | |
| 7,328,637 | B2 * | 2/2008 | Takashima et al. | 82/1.11 |
| 2001/0035326 | A1 * | 11/2001 | Furuta et al. | 192/56.61 |
| 2005/0245178 | A1 * | 11/2005 | Takashima et al. | 451/59 |
| 2006/0130331 | A1 * | 6/2006 | Takashima et al. | 29/896.6 |

FOREIGN PATENT DOCUMENTS

| | | | |
|---|---|---|---|
| JP | 7-54847 | A | 2/1995 |
| JP | 9-253904 | A | 9/1997 |
| JP | 11-207592 | A | 8/1999 |

(Continued)

*Primary Examiner* — David Angwin
(74) *Attorney, Agent, or Firm* — Foley & Lardner LLP

(57) ABSTRACT

An apparatus for forming recesses on a circumferential surface that defines a cylindrical bore in a workpiece includes a tool holder disposed coaxially with the cylindrical bore; a form roller support retained on the tool holder; a form roller rotatably supported on the form roller support, the form roller including projections on an outer circumferential surface thereof which are configured to form the recesses on the circumferential surface that defines the cylindrical bore in the workpiece. A control assembly is configured to control the form roller support such that the form roller is allowed to be in press contact with the circumferential surface that defines the cylindrical bore in the workpiece at a press contact load of a predetermined value on the basis of a centrifugal force which is exerted on the form roller support and the form roller during rotation of the tool holder.

30 Claims, 13 Drawing Sheets

(56) References Cited

FOREIGN PATENT DOCUMENTS

| | | | |
|---|---|---|---|
| JP | 11207592 | * | 8/1999 |
| JP | 2002-154487 | A | 5/2002 |
| JP | 2002-307310 | A | 10/2002 |
| JP | 2003-294085 | A | 10/2003 |
| JP | 2004-223570 | A | 8/2004 |
| JP | 2005-319476 | A | 11/2005 |
| JP | 2006-026676 | A | 2/2006 |
| WO | WO 01-32352 | A1 | 5/2001 |

* cited by examiner

APPARATUS FOR FORMING MICROSCOPIC RECESSES ON A CYLINDRICAL BORE SURFACE AND METHOD OF FORMING THE MICROSCOPIC RECESSES ON THE CYLINDRICAL BORE SURFACE BY USING THE APPARATUS

BACKGROUND OF THE INVENTION

The present invention relates to an apparatus for forming microscopic recesses on a circumferential surface that defines a cylindrical bore in a workpiece and comes into sliding contact with a counterpart, and a method of forming microscopic recesses on the circumferential surface thereof by using the apparatus. More specifically, in order to reduce friction occurring on the circumferential surface, the present invention relates to an apparatus for forming microscopic recesses as oil retention portions on the circumferential surface, for instance, a cylinder bore surface of a cylinder block of an engine for automobiles, a cylinder bore surface of a compressor, a sliding surface of a cylindrical bore of a slide member, a bearing surface of a cylindrical bore of a sliding bearing and the like, and relates to a method of forming microscopic recesses on the circumferential surface by using the apparatus.

Conventionally, upon forming microscopic recesses on a circumferential surface that defines a cylindrical bore in a workpiece, the circumferential surface is subjected to shot blasting. Upon shot blasting, a masking sheet with through-holes having a predetermined shape is attached to the circumferential surface, and then small-diameter shots, such as ceramic balls, are blasted with compressed air against the circumferential surface. As a result, microscopic recesses are formed on portions of the circumferential surface which are exposed outside through the through-holes. Subsequently, the masking sheet is taken off, and the circumferential surface is subjected to cleaning and honing to thereby remove protrudent peripheral portions around the microscopic recesses which are formed upon shot blasting. Japanese Patent Application First Publication No. 2002-307310 describes such a masking and blasting method as explained above.

Further, Japanese Patent Application First Publication No. 2005-319476 corresponding to U.S. Patent Application Publication No. 2005/0245178 A1 describes a microscopic recesses forming apparatus which includes a rotatable tool holder and a microrecess-forming unit moveable in a direction perpendicular to a rotation axis of the tool holder. The rotation axis of the tool holder is located offset from the center of gravity of the microrecess-forming unit. Therefore, when the tool holder is rotated at high speed, centrifugal force exerted to the microrecess-forming unit excessively increases in proportion to the square of the rotation speed of the tool holder. This results in that a form roller of the microrecess-forming unit is pressed against a cylindrical bore surface of a workpiece at a high load. To overcome thus problem, the form roller must be rotated at a low speed in order to press the form roller against the cylindrical bore surface at the low load. This causes deterioration in working efficiency of the apparatus and thereby increase in production cost of the apparatus.

SUMMARY OF THE INVENTION

However, in the shot blasting process of the conventional art as described above, it is difficult to regularly form the microscopic recess, and the operations of attaching and removing the masking sheet are inevitably required. This leads to failure of improvement in productivity. In addition, the use of the disposable masking sheet requires increased costs for a masking sheet material and adhesives, as well as costs of forming the through-holes in the masking sheet each time upon conducting the microscopic recess-forming process. This results in significant increase in production cost for production of the circumferential surface having the microscopic recesses.

It is an object of the present invention to provide an apparatus for forming microscopic recesses on a circumferential surface that defines a cylindrical bore in a workpiece and a method of forming the microscopic recesses on the circumferential surface by using the apparatus, which are capable of forming the microscopic recesses on the circumferential surface with high accuracy, improving the productivity and saving the production costs.

It is a further object of the present invention to provide an apparatus for forming microscopic recesses on a circumferential surface that defines a cylindrical bore in a workpiece and a method of forming the microscopic recesses on the circumferential surface by using the apparatus, which are capable of forming a predetermined pattern of the microscopic recesses on the circumferential surface regardless of a material and a hardness of the workpiece or a diameter of the cylindrical bore.

It is a further object of the present invention to provide an apparatus for forming microscopic recesses on a circumferential surface that defines a cylindrical bore in a workpiece and a method of forming the microscopic recesses on the circumferential surface by using the apparatus, which are capable of forming the microscopic recesses on the circumferential surface at a predetermined press contact load by canceling influence of a centrifugal force which is exerted on rotational members of the apparatus.

In one aspect of the present invention, there is provided an apparatus for forming microscopic recesses on a circumferential surface that defines a cylindrical bore in a workpiece, the apparatus comprising:

a tool holder disposed coaxially with the cylindrical bore and rotatably about a rotation axis;

a form roller support retained on the tool holder, the form roller support being moveable in a direction perpendicular to the rotation axis of the tool holder;

a form roller supported on the form roller support so as to be rotatable about a rotation axis that is parallel to the rotation axis of the tool holder, the form roller being formed with microscopic projections corresponding to the microscopic recesses to be formed on the circumferential surface that defines the cylindrical bore in the workpiece, on an outer circumferential surface of the form roller, and control means for controlling the form roller support such that the form roller is allowed to be in press contact with the circumferential surface that defines the cylindrical bore in the workpiece at a press contact load of a predetermined value on the basis of a centrifugal force which is exerted on the form roller support and the form roller during rotation of the tool holder.

In a further aspect of the present invention, there is provided a method of forming microscopic recesses on a circumferential surface that defines a cylindrical bore in a workpiece, by using the microscopic recesses forming apparatus of the present invention, the method comprising:

placing the tool holder and the workpiece in a relative position in which the tool holder and the cylindrical bore are coaxially arranged;

moving the form roller support to an offset position in which the rotation axis of the form roller is offset from the rotation axis of the tool holder;

rotating the tool holder about the rotation axis of the tool holder; and while placing the form roller support in the offset position, controlling a rotation speed of the tool holder such that the outer peripheral surface of the form roller is pressed against the circumferential surface that defines the cylindrical bore at a press contact load of a predetermined value based on a centrifugal force that is exerted on the form roller support and the form roller during rotation of the tool holder, to thereby roll the form roller on the circumferential surface that defines the cylindrical bore and form the microscopic recesses on the circumferential surface that defines the cylindrical bore.

In a still further aspect of the present invention, there is provided a method of forming microscopic recesses on a circumferential surface that defines a cylindrical bore in a workpiece, by using the microscopic recesses forming apparatus of the present invention, the method comprising:

placing the tool holder and the workpiece in a relative position in which the tool holder and the cylindrical bore are coaxially arranged;

moving the form roller support to an offset position in which the rotation axis of the form roller is offset from the rotation axis of the tool holder;

rotating the tool holder about the rotation axis of the tool holder; and while rotating the tool holder about the rotation axis of the tool holder, controlling the form roller support such that the outer peripheral surface of the form roller is pressed against the circumferential surface that defines the cylindrical bore at a press contact load of a predetermined value depending on a rotation speed of the tool holder, to thereby roll the form roller on the circumferential surface that defines the cylindrical bore and form the microscopic recesses on the circumferential surface that defines the cylindrical bore.

In a still further aspect of the present invention, there is provided a method of forming microscopic recesses on a circumferential surface that defines a cylindrical bore in a workpiece, by using the microscopic recesses forming apparatus of the present invention, the method comprising:

placing the tool holder and the workpiece in a relative position in which the tool holder and the cylindrical bore in the workpiece are coaxially arranged;

rotating the tool holder about the rotation axis of the tool holder;

moving the form roller support to an offset position in which the rotation axis of the form roller is offset from the rotation axis of the tool holder, and at the same time, moving a counterweight toward an opposite side of the form roller support and the form roller with respect to the rotation axis of the tool holder until the counterweight is placed in a balanced position in which rotation balance of the tool holder is attainable; and while rotating the tool holder about the rotation axis of the tool holder, controlling the form roller support such that the outer peripheral surface of the form roller is pressed against the circumferential surface that defines the cylindrical bore at a press contact load of a predetermined value, to thereby roll the form roller on the circumferential surface that defines the cylindrical bore and form the microscopic recesses on the circumferential surface that defines the cylindrical bore.

In a still further aspect of the present invention, there is provided a method of forming microscopic recesses on a circumferential surface that defines a cylindrical bore in a workpiece, by using the microscopic recesses forming apparatus of the present invention, the method comprising:

placing the tool holder and the workpiece in a relative position in which the tool holder and the cylindrical bore in the workpiece are coaxially arranged;

moving the form roller support until the form roller is positioned within the cylindrical bore when viewed in a direction of a central axis of the cylindrical bore;

rotating the tool holder about the rotation axis of the tool holder;

relatively moving the tool holder and the workpiece in a direction along the central axis of the cylindrical bore until the form roller has reached a predetermined position relative to the circumferential surface that defines the cylindrical bore in which the outer peripheral surface of the form roller is opposed to the circumferential surface that defines the cylindrical bore; and moving the form roller support to an offset position in which the rotation axis of the form roller is offset from the rotation axis of the tool holder, and at the same time, moving a counterweight toward an opposite side of the form roller support and the form roller with respect to the rotation axis of the tool holder until the counterweight is placed in a balanced position in which rotation balance of the tool holder is attainable; and while rotating the tool holder about the rotation axis of the tool holder, controlling the form roller support such that the outer peripheral surface of the form roller is pressed against the circumferential surface that defines the cylindrical bore at a press contact load of a predetermined value, to thereby roll the form roller on the circumferential surface that defines the cylindrical bore and form the microscopic recesses on the circumferential surface that defines the cylindrical bore.

a schematic plan view of a form roller of the apparatus of the first embodiment and a cylindrical bore in a workpiece, which illustrates an operation of the form roller upon forming microscopic recesses.

Figure 3:
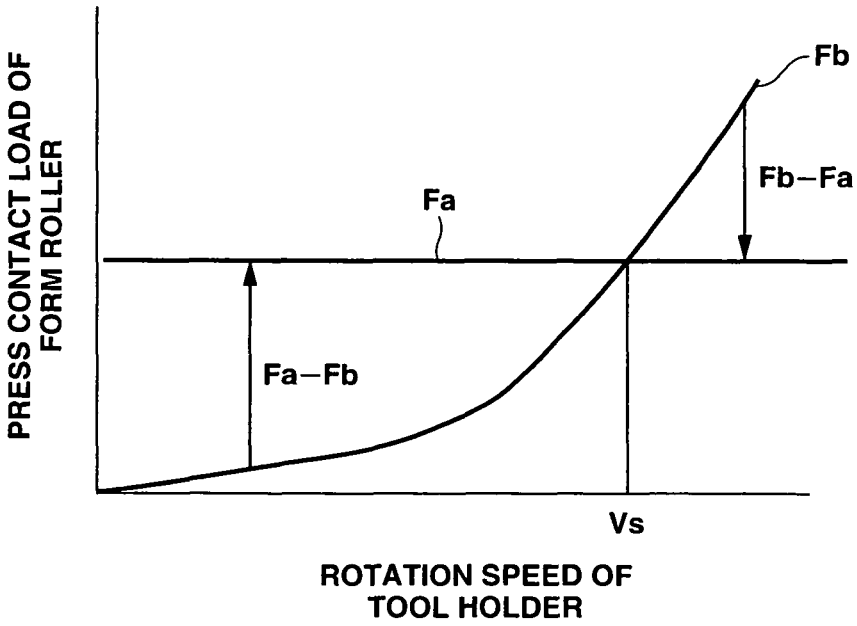

FIG. 3 is a graph that illustrates a relationship between press contact load of a form roller and rotation speed of a tool holder.

Figure 1:
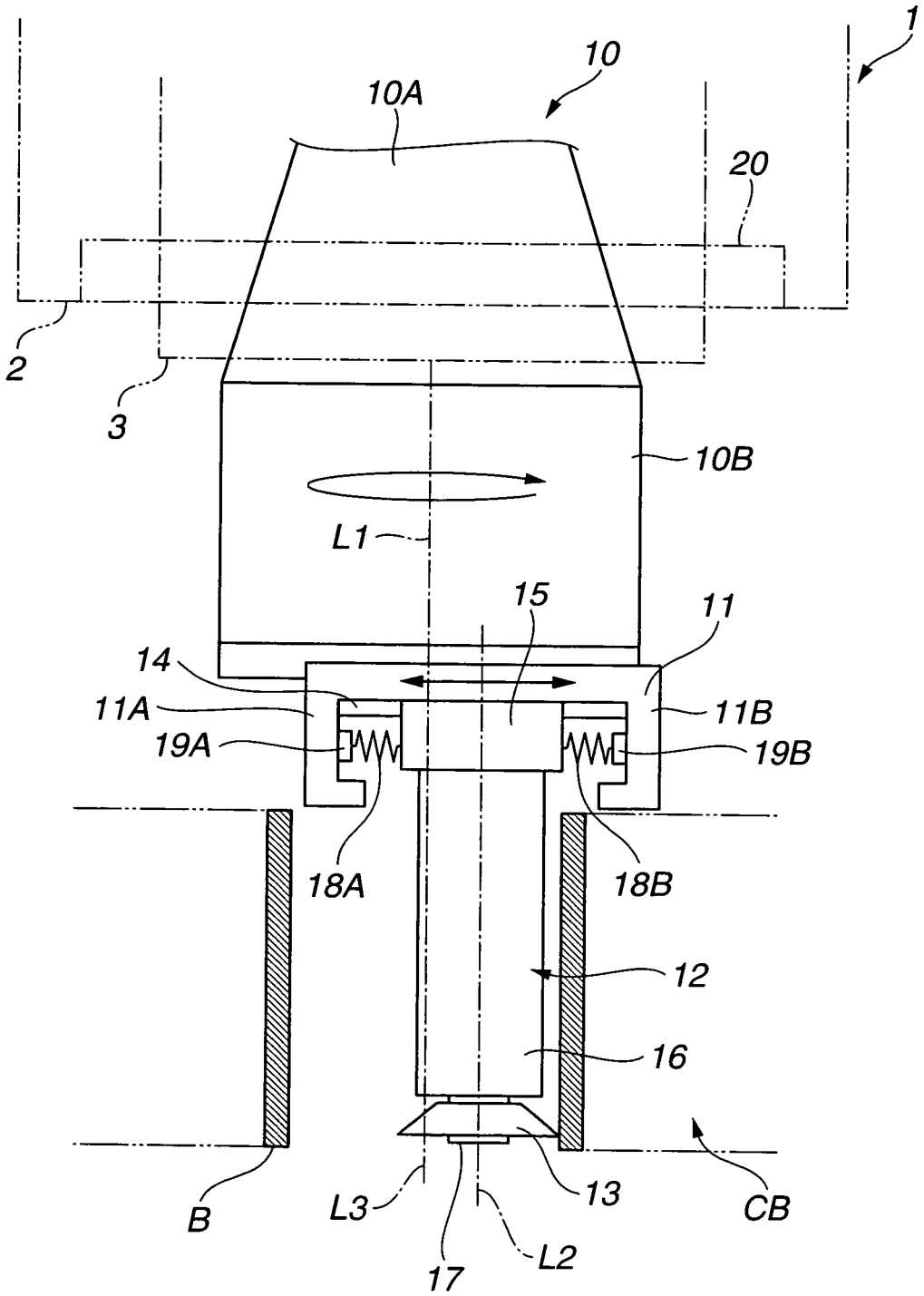
FIG. 1 is a vertical cross-section of an essential part of an apparatus according to a first embodiment of the present invention.
Figure 4:
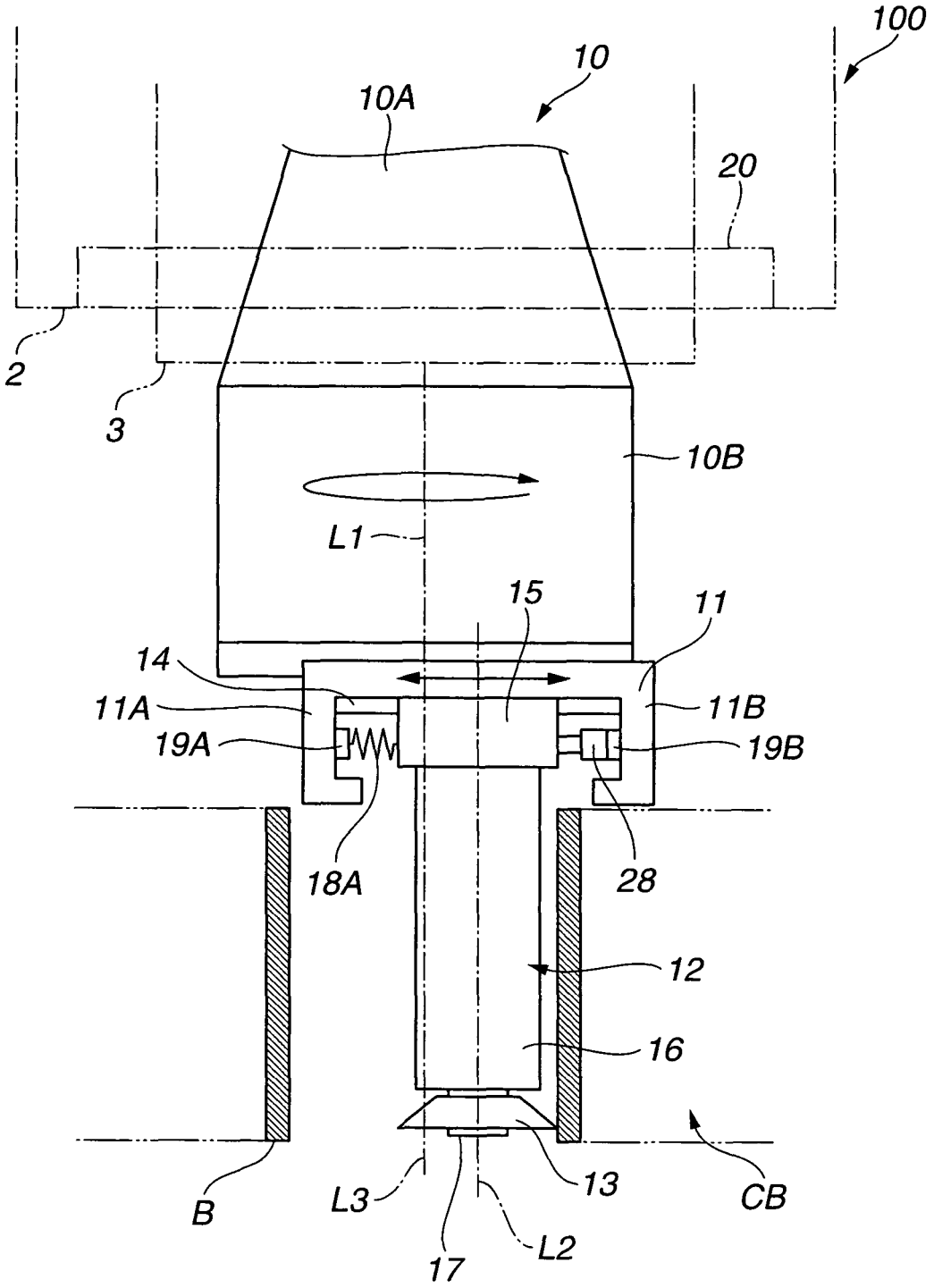

FIG. 4 is a diagram similar to FIG. 1, but showing a second embodiment of the present invention.

Figure 5:
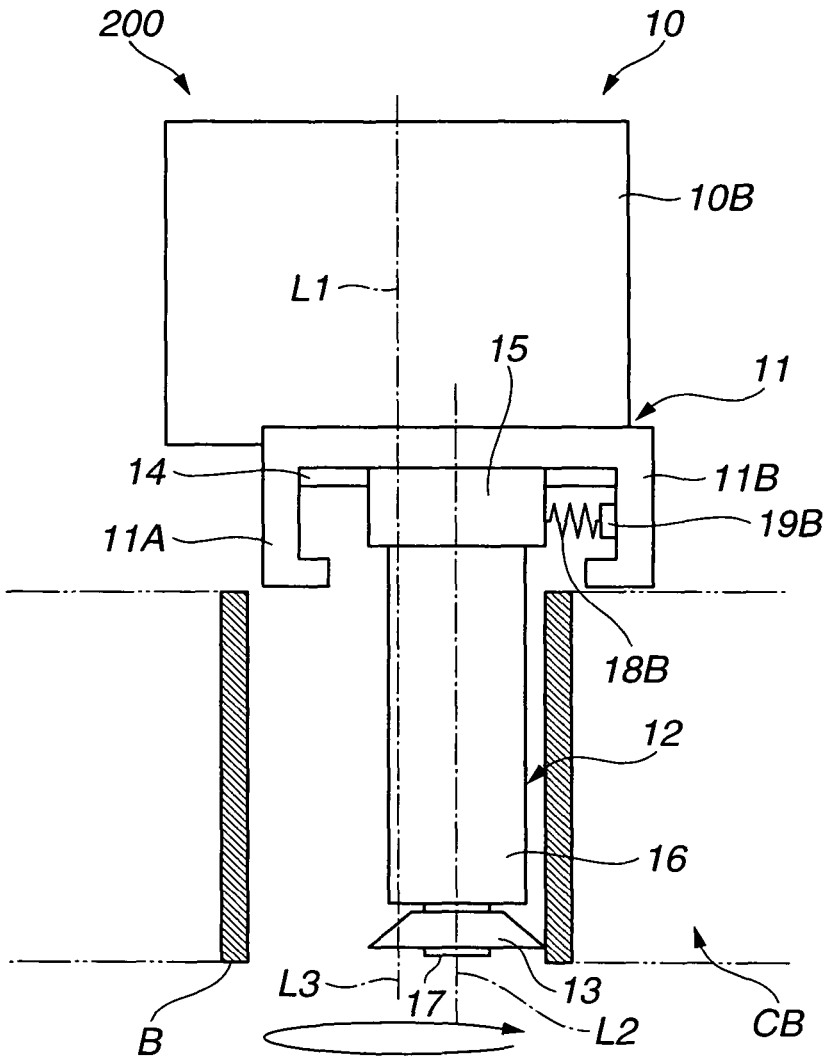

FIG. 5 is a diagram similar to FIG. 1, but showing a third embodiment of the present invention.

Figure 6:
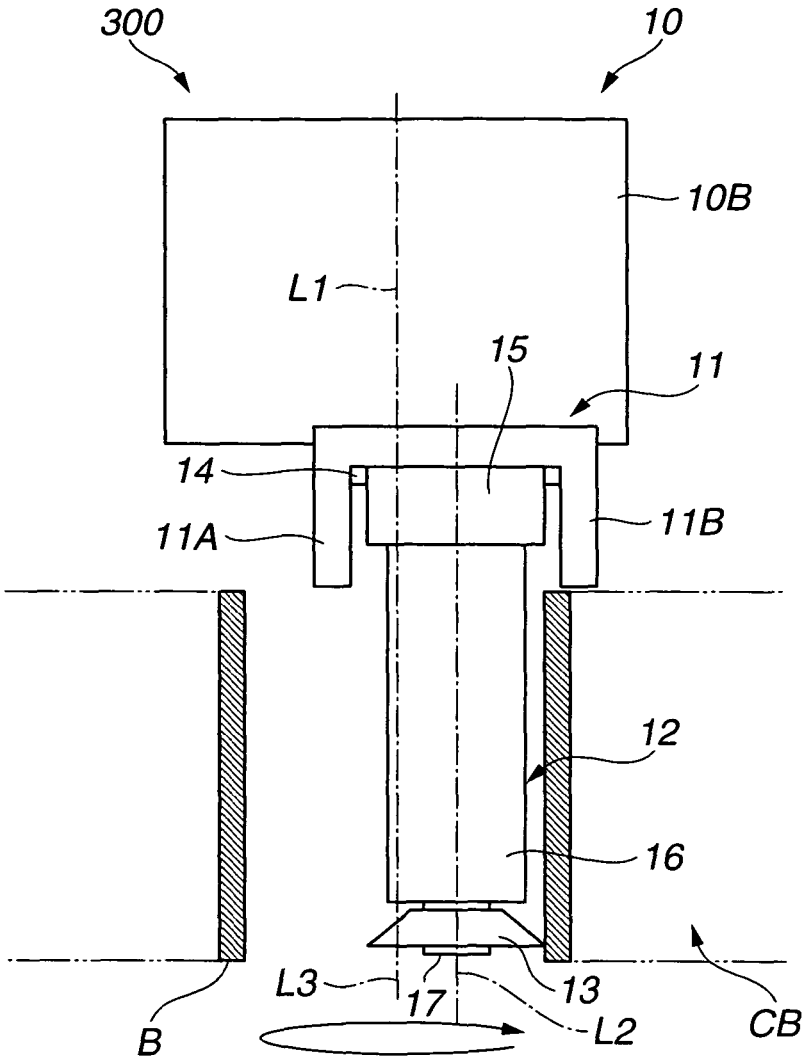

FIG. 6 is a diagram similar to FIG. 1, but showing a fourth embodiment of the present invention.

Figure 7:
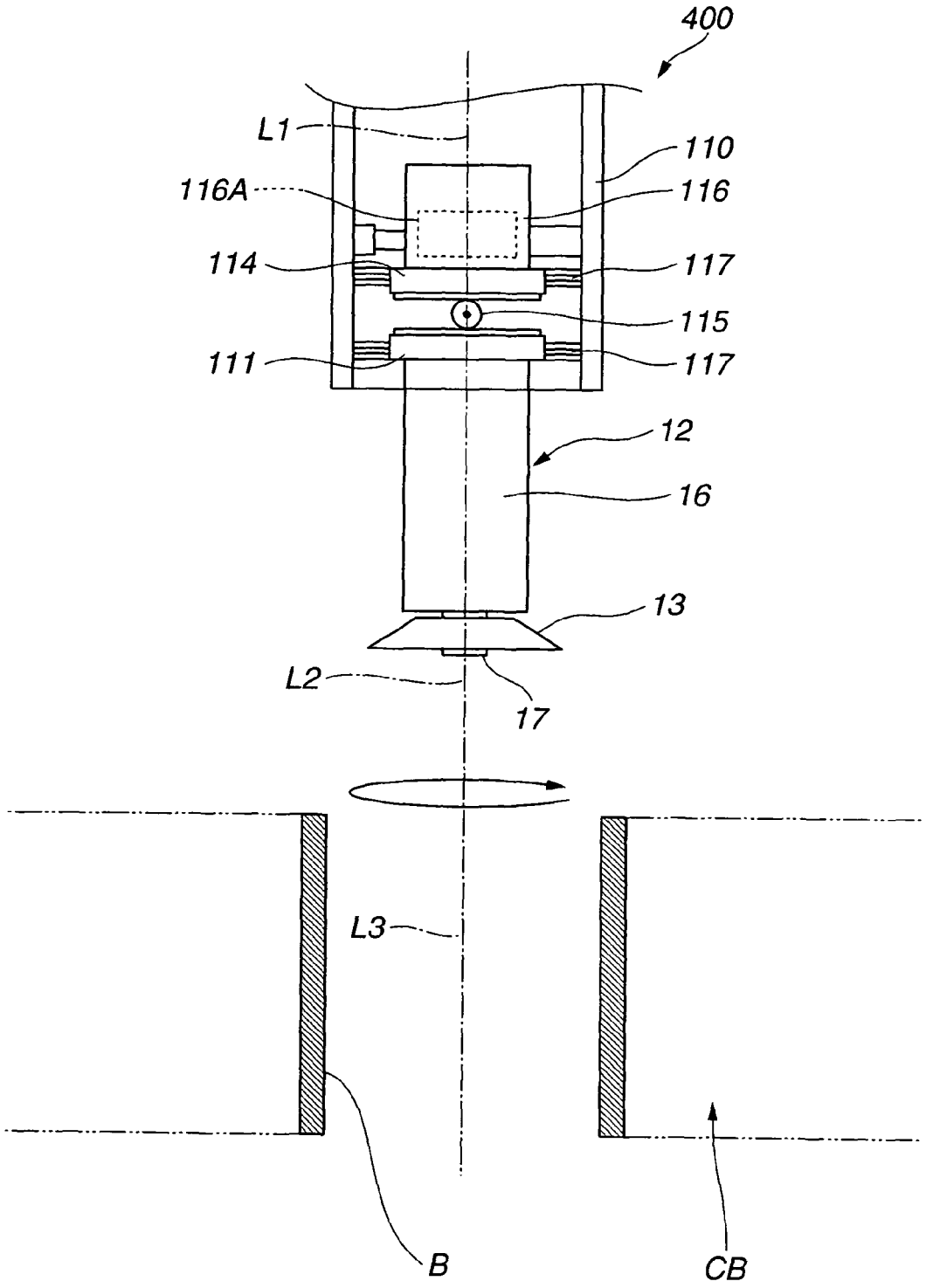

FIG. 7 is a vertical cross-section of an essential part of an apparatus according to a fifth embodiment of the present invention.

Figure 8:
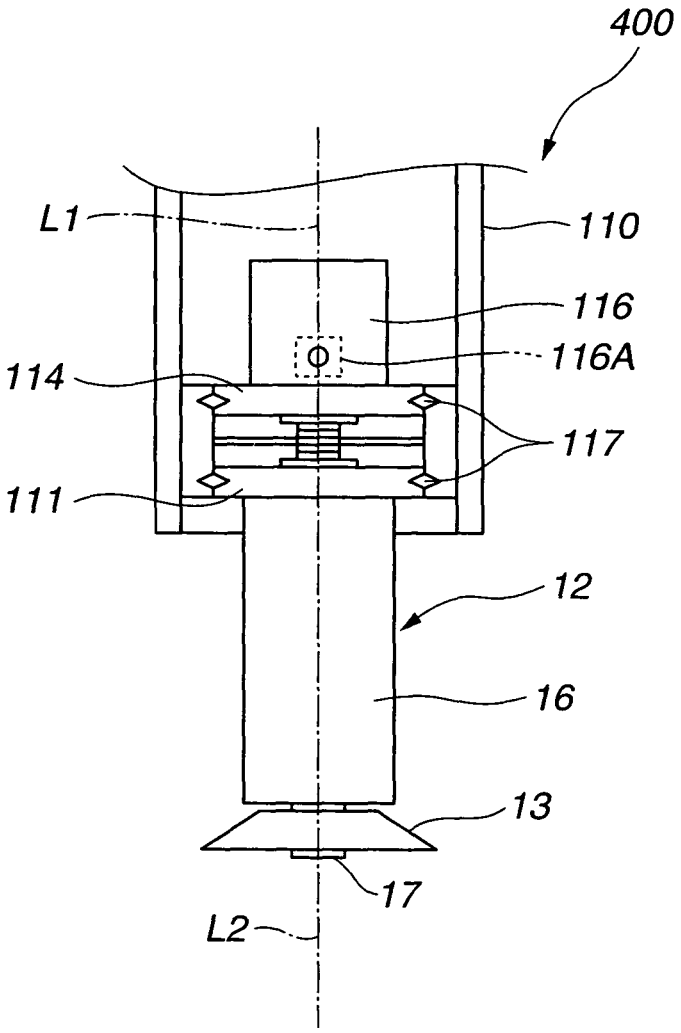

FIG. 8 is a side view of the essential part of the apparatus shown in FIG. 7.

Figure 9:
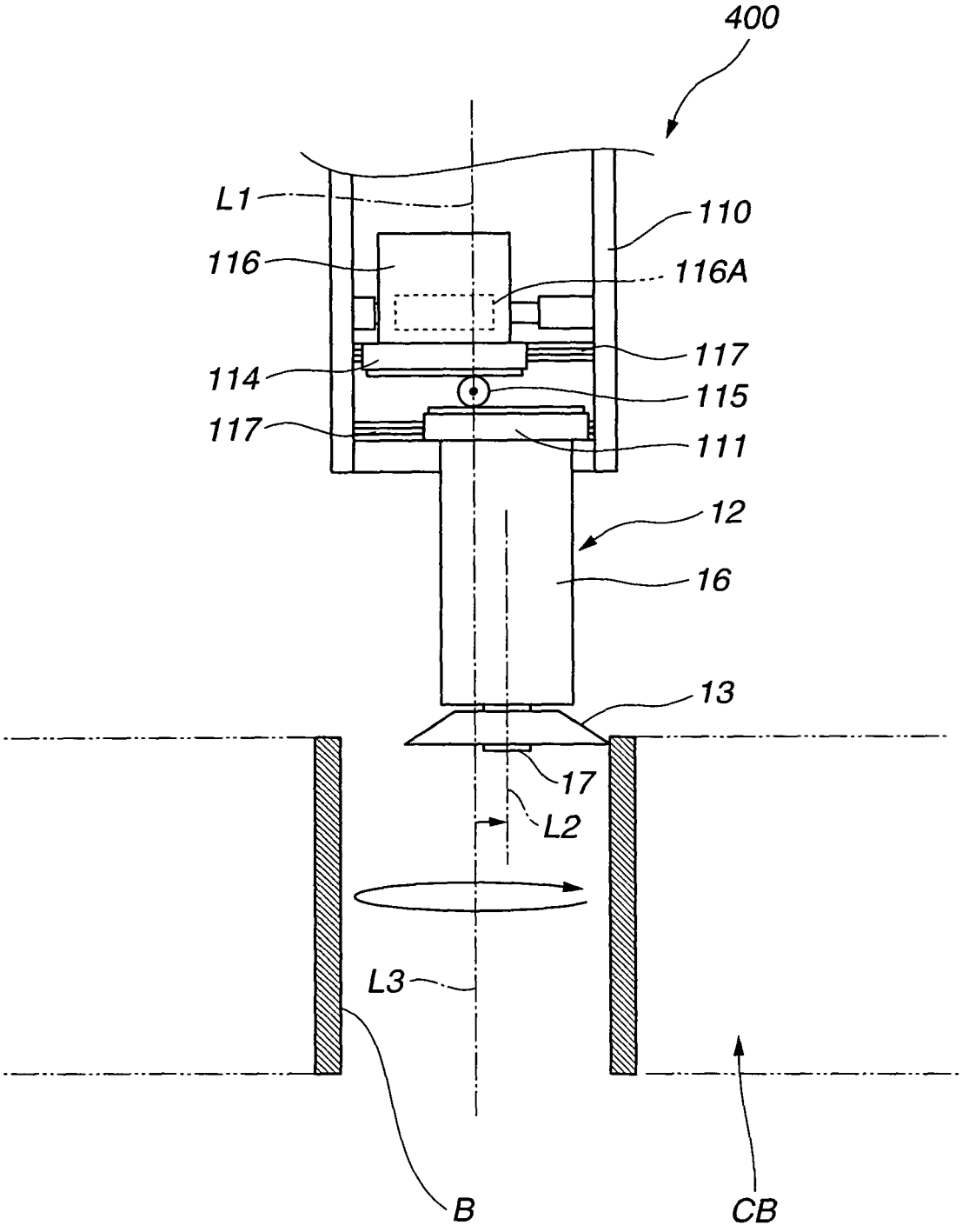

FIG. 9 is a diagram that illustrates a start state of an operation of the apparatus.

Figure 10:
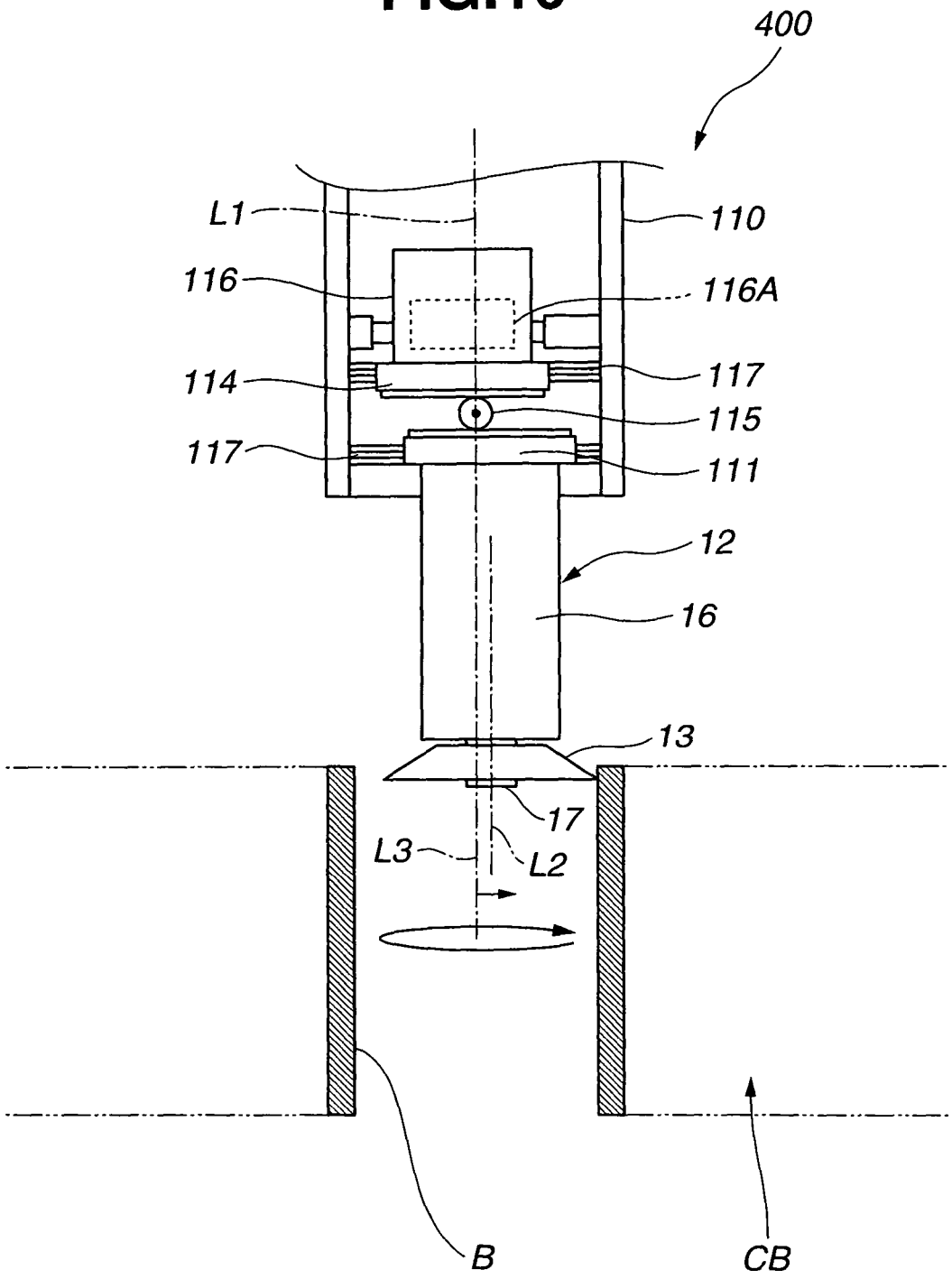

FIG. 10 is a diagram similar to FIG. 9, but illustrates a start state of an operation of the apparatus in a case where a cylinder bore has a small diameter.

Figure 11:
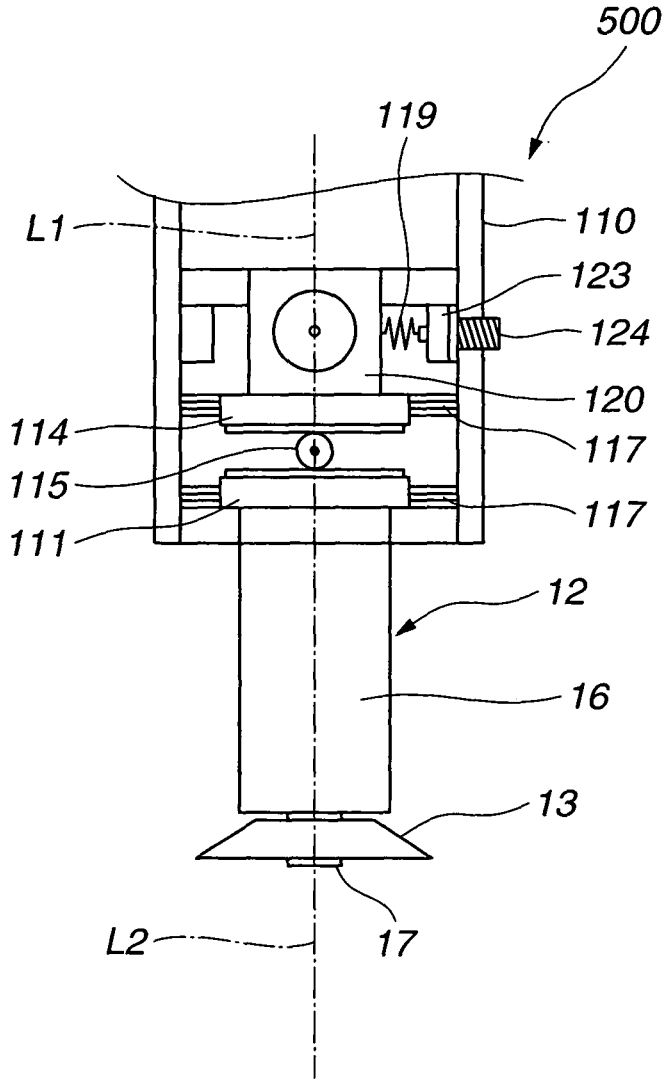

FIG. 11 is a vertical cross-section of an essential part of an apparatus according to a sixth embodiment of the present invention.

Figure 12:
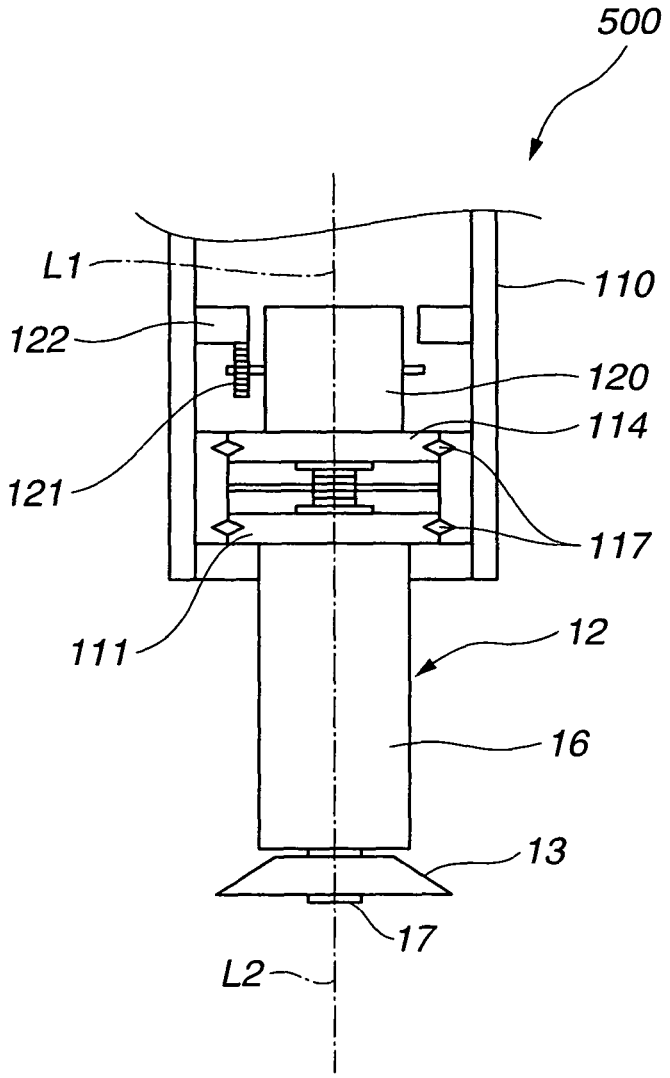

FIG. 12 is a side view of the essential part of the apparatus shown in FIG. 11.

Figure 13:
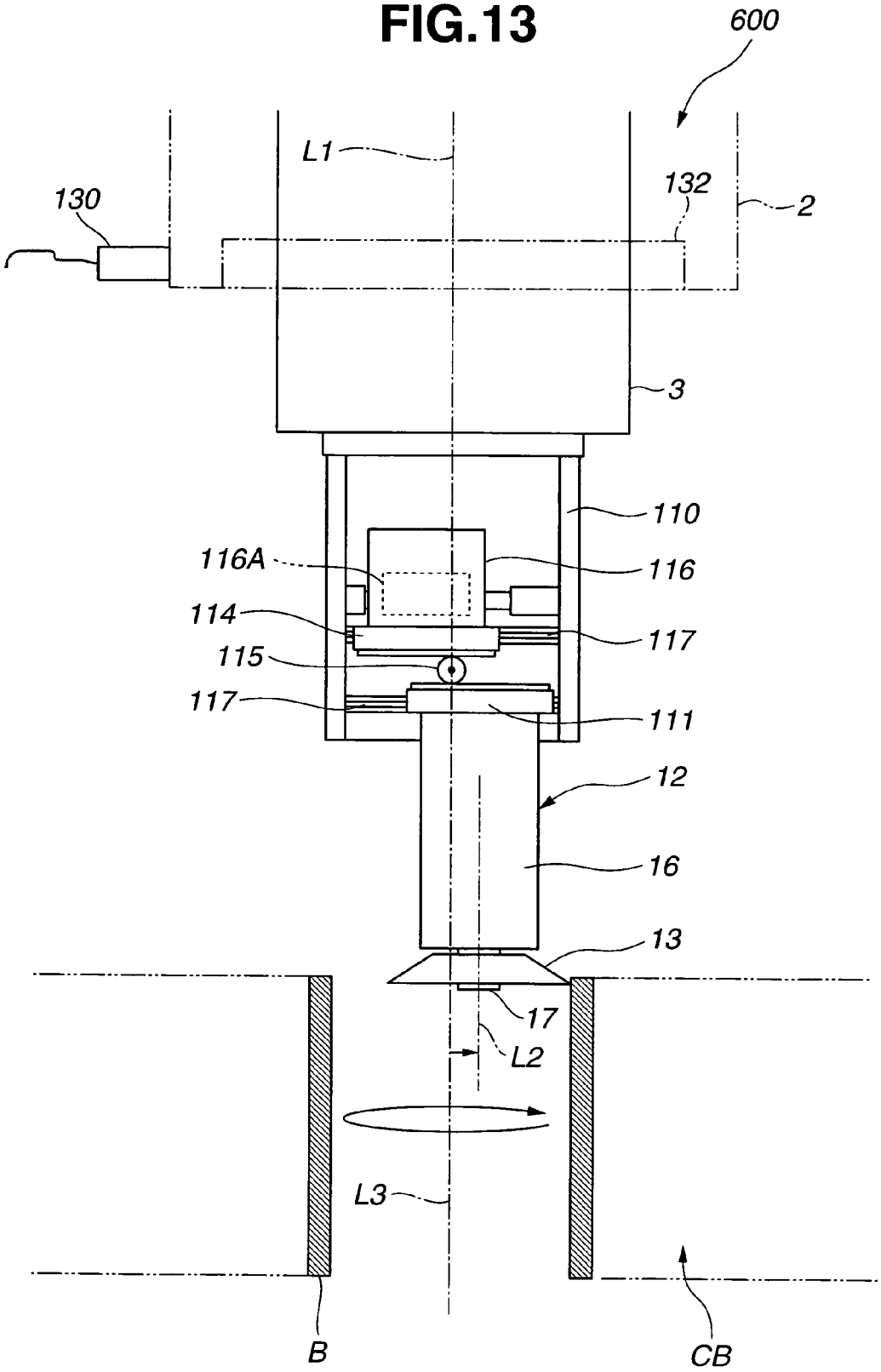

FIG. 13 is a vertical cross-section of an essential part of an apparatus according to a seventh embodiment of the present invention.

DETAILED DESCRIPTION OF THE INVENTION

Figure 2:
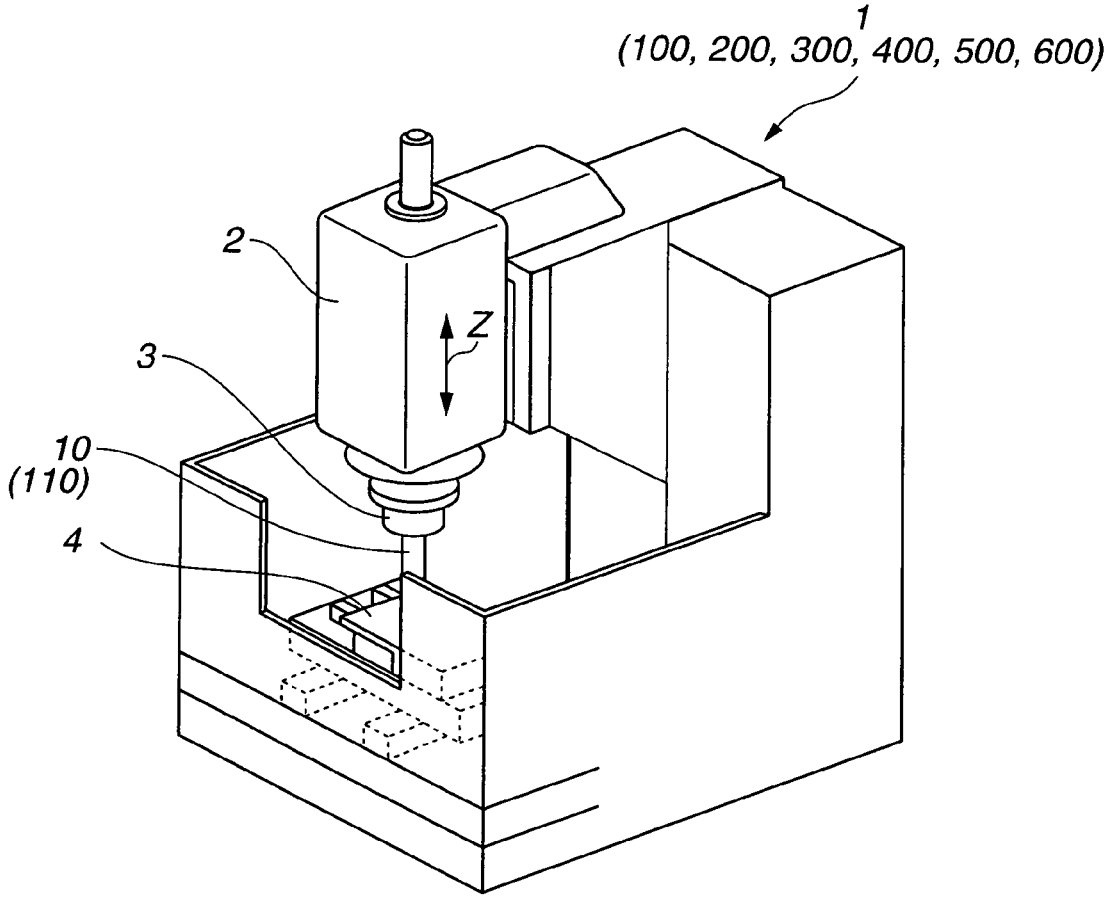
FIG. 2 is a perspective view of the apparatus as a whole.

In the followings, embodiments of the present invention will be described with reference to the accompanying drawings. The terms "upper", "lower", "upward", "downward", "rightward" and "leftward" used in the following description merely denote directions as viewed in the drawings. FIGS. 1 and 2 illustrate a first embodiment of an apparatus for forming microscopic recesses on a circumferential surface that defines a cylindrical bore of a workpiece, according to the present invention. In FIG. 2, apparatus 1 of the first embodiment is provided as a numerical control machine tool, i.e., a NC machine tool, which forms microscopic recesses on a circumferential surface of a cylinder bore of a cylinder block of an engine for automobiles. As illustrated in FIG. 2, apparatus 1 includes main shaft head 2 moveable in vertical direction Z, and main shaft 3 that is supported on main shaft head 2 so as to downwardly project from a lower end of main shaft head 2. Apparatus 1 further includes support platform 4 disposed beneath main shaft head 2, and tool holder 10 that is disposed so as to be coaxial with main shaft 3 and rotatable about a rotation axis together therewith. Support platform 4 is moveable in two directions that are perpendicular to each other in a horizontal plane. A cylinder block as a workpiece is retained on support platform 4. Tool holder 10 is detachably mounted to main shaft 103 by using an automatic tool interchange device, not shown.

As illustrated in FIG. 1, tool holder 10 includes shank 10A mounted to main shaft 103, and body 10B continuously connected with shank 10A. Adapter 11 is disposed on a lower side of body 10B and acts as a radial movement member moveable in a radial direction of tool holder 10 which is perpendicular to rotation axis L1 of tool holder 10. In other words, adapter 11 is moveable in a radial direction of cylinder bore B of cylinder block CB. Adapter 11 includes a built-in moving mechanism equipped with a driver, for instance, a stepping motor, not shown. The moving mechanism allows adapter 11 to move relative to tool holder 10 in the radial direction of tool holder 10, namely, in the radial direction of cylinder bore B, so that form roller support 12 and form roller 13 are moveably supported on adapter 11 in the radial direction of tool holder 10. Adapter 11 further includes horizontal guide 14 for guiding form roller support 12 along the radial direction of tool holder 10.

Form roller support 12 is mounted to a lower surface of adapter 11 through guide 14. Form roller support 12 is thus supported on tool holder 10 via adapter 11 so as to be slidably moveable parallel to the direction of the movement of adapter 11, namely, parallel to the radial direction of tool holder 10. Form roller 13 is supported on form roller support 12 so as to be rotatable about rotation axis L2 parallel to rotation axis L1 of tool holder 10. Form roller 13 is moveable together with form roller support 12 to advance and retreat with respect to a circumferential surface that defines cylinder bore B of cylinder block CB. Specifically, form roller support 12 includes slide 15 that is guided by horizontal guide 14 of adapter 11, and support body 16 that depends from slide 15. Form roller 13 is rotatably mounted to a lower end portion of support body 16 through support shaft 17. Support shaft 17 extends vertically and downwardly from support body 16 and has a combined angular contact ball bearing. Support shaft 17 has a central axis that acts as rotation axis L2 of form roller 13.

Form roller 13 has a diameter smaller than a diameter of cylinder bore B of cylinder block CB. Form roller 13 is so configured as to form microscopic recesses on the circumferential surface that defines cylinder bore B of cylinder block CB. Specifically, microscopic projections are formed on an outer peripheral surface of form roller 13. The microscopic projections may be in the form of protrusions spaced from each other at predetermined intervals so as to form dimple-shaped microscopic recesses on the circumferential surface of cylinder bore B, or may be in the form of a continuously extending projection so as to form a continuously extending microscopic groove on the circumferential surface of cylinder bore B. Form roller 13 may be made of a suitable material, for instance, cemented carbide, hard metal, alumina, ceramic such as silicon nitride, and the like. Form roller 12 has high rigidity and toughness such that even in a case where the workpiece is made of high hardness material such as hardened steel, microscopic recesses can be formed on a surface of the workpiece.

First load generating member 18A and first load detector 19A are disposed between downwardly extending retainer 11A of adapter 11 and slide 15 of form roller support 12. First load generating member 18A generates a load which is applied to form roller support 12 in such a direction that form roller 13 advances toward the circumferential surface of cylinder bore B, namely, rightward in FIG. 1. First load detector 19A detects the load that is generated by first load generating member 18A. In this embodiment, first load generating member 18A is a compression coil spring, and first load detector 19A is a piezoelectric load cell.

Second load generating member 18B and second load detector 19B are disposed between downwardly extending retainer 11B of adapter 11 and slide 15 of form roller support 12. Retainer 11B is spaced from retainer 11A in the direction of the movement of adapter 11 with respect to body 10B of tool holder 10. Second load generating member 18B generates a load which is applied to form roller support 12 in such a direction that form roller 13 retreats relative to the circumferential surface of cylinder bore B, namely, leftward in FIG. 1. Second load detector 19B detects the load that is generated by second load generating member 18B. In this embodiment, second load generating member 18B is a compression coil spring, and second load detector 19B is a piezoelectric load cell.

In this embodiment, by the adoption of the compression coil springs as first and second load generating members 18A, 18B, a simple and compact construction of apparatus 1 can be provided to produce a sufficient load to be applied to form roller support 12 and form roller 13. Further, the adoption of the load cells as first and second load detectors 19A, 19B also serves for providing the simple and compact construction of apparatus 1, and accurately detecting the loads which are generated by first and second load generating members 18A, 18B.

Rotation speed detector 20 that detects rotation speed (rotation number) of tool holder 10 is provided on a lower end portion of main shaft head 2. Specifically, rotation speed detector 20 detects rotation speed of main shaft 3 that makes unitary rotation with tool holder 10. In this embodiment, rotation speed detector 20 is a rotary encoder. By using the rotary encoder, apparatus 1 of this embodiment can be more simplified in construction and improved in accuracy of the detection.

Apparatus 1 further includes an axial movement member that causes a relative axial movement of cylinder block CB and tool holder 10 along central axis L3 of cylinder bore B of cylinder block CB. In this embodiment, main shaft head 2 acts as the axial movement member that is moveable together with tool holder 10 relative to cylinder block CB along central axis L3 of cylinder bore B.

First and second load detectors 19A, 19B are electronically connected to a control unit. The control unit receives detection signals transmitted from first and second load detectors 19A, 19B and rotation speed detector 20 and controls operations of main shaft head 2, main shaft 3, support platform 4 and adapter 11 on the basis of the detection signals.

A method of forming microscopic recesses on the circumferential surface that defines cylinder bore B of cylinder block CB by using apparatus 1 of this embodiment will be explained hereinafter. First, cylinder block CB is placed on support platform 4 such that rotation axis L1 of tool holder 10 and central axis L3 of cylinder bore B are in alignment with each other. Subsequently, main shaft head 2 is operated to downwardly move tool holder 10 in a direction along central axis L3 of cylinder bore B such that form roller 13 enters into cylinder bore B.

Next, adapter 11 is driven to advance form roller support 12 and form roller 13 toward the circumferential surface defining cylinder bore B and bring the outer peripheral surface of form roller 13 into contact therewith. Then, adapter 11 is continuously advanced until the load detected by first load detector 19A reaches a predetermined value.

Specifically, when the advancing movement of adapter 11 is continued after contacting the outer peripheral surface of form roller 13 with the circumferential surface of cylinder bore B, the compression coil spring as first load generating member 18A is compressed between adapter 11 and form roller support 12 to thereby cause a reaction force as a load that is applied to form roller 13. The reaction force as a load is detected by load detector 19A. By continuing the advancing movement of adapter 11 until the load detected reaches the predetermined value, the outer peripheral surface of form roller 13 is pressed against the circumferential surface of cylinder bore B by the load of the predetermined value.

In this condition, form roller 13 is placed in an offset position in which rotation axis L2 of form roller 13 is offset from rotation axis L1 of tool holder 10 in a parallel relation thereto. A center of gravity of a microrecess-forming unit that is constituted of adapter 11, form roller support 12 and form roller 13 is located offset from rotation axis L1 of tool holder 10 and on a side of form roller 13.

Subsequently, at the time at which the load of the predetermined value is detected by first load detector 19A, the advancing movement of adapter 11 is terminated and then main shaft 3 is driven to rotate together with tool holder 10 about rotation axis L1. While rotating tool holder 10, the outer peripheral surface of form roller 13 is pressed against the circumferential surface of cylinder bore B, so that form roller 13 turns about rotation axis L1 of tool holder 10 and rolls on the circumferential surface of cylinder bore B. As a result, microscopic recesses are formed on the circumferential surface of cylinder bore B. At this time, if the rotating movement of main shaft 3 and the downward-axial movement of main shaft head 2 are synchronized with each other, the microscopic recesses can be continuously formed on the circumferential surface of cylinder bore B along a spiral trail of form roller 13. Thus, the microscopic recesses can be efficiently formed over a wide area of the circumferential surface of cylinder bore B.

In apparatus 1 and the method of forming the microscopic recesses by using apparatus 1, the loads respectively generated by first and second load generating members 18A and 18B are detected by first and second load detectors 19A and 19B, and the rotation speed of tool holder 10 is detected by rotation speed detector 20. A press contact load of form roller 13 at which the outer peripheral surface of form roller 13 is pressed against the circumferential surface of cylinder bore B during the rotation of tool holder 10 is controlled at a predetermined value depending on the rotation speed of tool holder 10 as explained hereinafter.

Preferably, in the previous step in which form roller 13 is moved into cylinder bore B, tool holder 10 is rotatively driven, and the rotation speed thereof and a centrifugal force caused on form roller support 12 and form roller 13 due to the rotation of tool holder 10 are measured. During the subsequent step of forming the microscopic recesses, the press contact load of form roller 13 is controlled on the basis of a relationship between the rotation speed of tool holder 10 and the centrifugal force which is obtained at the previous step and data of the detected loads of first and second load generating members 18A and 18B and the detected rotation speed of tool holder 10 which are obtained during the previous microscopic recesses formation step.

Specifically, when form roller support 12 is placed in the offset position, rotation axis L2 of form roller 13 is offset from rotation axis L1 of tool holder 10 so that the center of gravity of the microrecess-forming unit of apparatus 1 is located on the side of form roller 13. Further, when the outer peripheral surface of form roller 13 is pressed against the circumferential surface of cylinder bore B while rotating tool holder 10, form roller 13 is turned about rotation axis L1 of tool holder 10, whereby a centrifugal force is exerted on form roller support 12 and form roller 13 depending on the rotation speed of tool holder 10.

FIG. 3 shows the relationship between rotation speed of tool holder 10 and centrifugal force Fb that is exerted on form roller support 12 and form roller 13 depending on the rotation speed. As illustrated in FIG. 3, as the rotation speed of tool holder 10 becomes larger, centrifugal force Fb is increased. The increase in centrifugal force Fb causes increase in the press contact load of form roller 13.

In apparatus 1 and the method of forming the microscopic recesses by using apparatus 1, as shown in FIG. 3, reference press contact load Fa of form roller 13 and reference rotation speed Vs are set on the basis of the relationship between the rotation speed of tool holder 10 and centrifugal force Fb. Here, reference press contact load Fa is the press contact load of the predetermined value at which the microscopic recesses having desired size and depth can be formed on the circumferential surface of cylinder bore B. Reference rotation speed Vs is the rotation speed at which reference press contact load Fa and centrifugal force Fb are equivalent in magnitude to each other.

Basically, in both of the case where centrifugal force Fb is smaller than reference press contact load Fa and the case where centrifugal force Fb is larger than reference press contact load Fa, the press contact load of form roller 13 is controlled at reference press contact load Fa by controlling the loads generated by first and second load generating members 18A and 18B so as to cancel influence of centrifugal force Fb depending on the rotation speed of tool holder 10. Specifically, if the rotation speed of tool holder 10 is smaller than reference rotation speed Vs and centrifugal force Fb is smaller than reference press contact load Fa, the load generated by first load generating member 18A is reduced by an amount corresponding to centrifugal force Fb to thereby control the press contact load of form roller 13 at reference press contact load Fa. Practically, adapter 11 is moved in such a direction that form roller 13 retreats relative to the circumferential surface of cylinder bore B until the load generated by first load generating member 18A is reduced by the amount corresponding to centrifugal force Fb to thereby become equal to difference (Fa−Fb) between reference press contact load Fa and centrifugal force Fb.

On the other hand, if the rotation speed of tool holder 10 is larger than reference rotation speed Vs and centrifugal force Fb is larger than reference press contact load Fa, in addition to reduction in the load generated by first load generating member 18A, the load generated by second load generating member 18B is increased so as to cancel influence of centrifugal force Fb to thereby control the press contact load of form roller 13 at reference press contact load Fa. Practically, adapter 11 is moved in the direction of the retreating movement of form roller 13 relative to the circumferential surface of cylinder bore B until influence of centrifugal force Fb is cancelled such that the load generated by second load generating member 18B becomes equal to difference (Fb−Fa) between centrifugal force Fb and reference press contact load Fa. In this case of Fb>Fa, even when the load generated by first load generating member 18A is reduced to zero by moving adapter 11 in the direction such that form roller 13 retreats from the circumferential surface of cylinder bore B, the press contact load of form roller 13 exceeds reference press contact load Fa. Therefore, it is required to increase the load generated by second load generating member 18B in addition to reducing the load generated by first load generating member 18A.

As is understood from the above explanation, apparatus 1 of the first embodiment and the method of forming the microscopic recesses by using apparatus 1 can provide microscopic recesses on the circumferential surface of cylinder bore B of cylinder block CB with high efficiency and high accuracy. Further, form roller 13 can be in press contact with the circumferential surface of cylinder bore B at the press contact load of the predetermined value. Therefore, it is possible to omit previous works for the circumferential surface of cylinder bore B which must be conventionally performed with high accuracy before forming the microscopic recesses thereon. This realizes significant reduction in the number of production steps and the production cost.

Further, by using first load generating member 18A that generates the load to be applied to form roller 13 in the advance direction with respect to the circumferential surface of cylinder bore B and second load generating member 18B that generates the load to be applied to form roller 13 in the retreat direction with respect to the circumferential surface of cylinder bore B, the centrifugal force that is exerted on form roller support 12 and form roller 13 in the step of forming the microscopic recesses can be cancelled. Therefore, even when tool holder 10 is rotated at high speed, the microscopic recesses having uniform depth and size can be formed with a relatively small contact load, and working efficiency upon formation of the microscopic recesses can be further enhanced. In addition, apparatus 1 is simplified in construction and downsized to thereby be useable for forming microscopic recesses on a circumferential surface of the cylinder bore that has a relatively small diameter.

Further, since apparatus 1 includes adapter 11 that is moveable in the radial direction of tool holder 10, apparatus 1 can be used for cylinder bores different in diameter. Further, it is possible to form the microscopic recesses such that size and depth thereof are varied in different areas of the circumferential surface of cylinder bore B by controlling the press contact load of form roller 13 during the step of forming the microscopic recesses.

The microscopic recesses regularly arranged on the circumferential surface of cylinder bore B are formed by using apparatus 1 and the method of this embodiment and effectively act as oil retention portions. With the provision of the microscopic recesses, the circumferential surface of cylinder bore B of cylinder block CB can show reduced friction that will occur upon undergoing sliding contact with a piston, serving for enhancing an engine output.

Referring to FIG. 4, a second embodiment of the apparatus of the present invention will be explained, which differs from the first embodiment in that an actuator is used as the second load generating member. Like reference numerals denote like parts, and therefore, detailed explanations therefor are omitted. As illustrated in FIG. 4, apparatus 100 of the second embodiment includes actuator 28 that is disposed between retainer 11B of adapter 11 and slide 15 of form roller support 12 and is driven to expand in the direction of the retreat movement of form roller 13 relative to the circumferential surface of cylinder bore B. When the rotation speed of tool holder 10 is larger than reference rotation speed Vs and centrifugal force Fb is larger than reference press contact load Fa, the press contact load of form roller 13 is maintained at reference press contact load Fa by driving actuator 28 to expand in the direction of the retreat movement of form roller 13 relative to the circumferential surface of cylinder bore B. Practically, without moving adapter 11 in the direction of the retreat movement of form roller 13, actuator 28 is driven to expand in the direction of the retreat movement of form roller 13 to thereby increase the load to be applied to form roller 13 by an amount corresponding to centrifugal force Fb. As a result, the press contact load of form roller 13 is maintained at reference press contact load Fa.

Apparatus 100 of the second embodiment can perform substantially the same functions and effects as those of apparatus 1 of the first embodiment. Similar to apparatus 1 of the first embodiment, with the provision of adapter 11, apparatus 100 of the second embodiment can be used for cylinder bores having different diameters from each other. Further, in apparatus 100 of the second embodiment in which compression coil spring 18A is used as the first load generating member and actuator 28 is used as the second load generating member, the centrifugal force that is exerted on form roller support 12 and form roller 13 can be cancelled in the step of forming the microscopic recesses.

Further, such an actuator as actuator 28 can be used as the respective first and second load generating members. In such a case, adapter 11 can be adopted or omitted. In the case where adapter 11 is omitted, apparatus 100 can be further simplified in construction than apparatus 1 of the first embodiment.

Referring to FIG. 5, a third embodiment of the apparatus of the present invention is explained, which differs from the first embodiment in that first load generating member 18A and first load detector 19A of the fist embodiment are omitted. Like reference numerals denote like parts, and therefore, detailed explanations therefor are omitted.

As illustrated in FIG. 5, in apparatus 200 of the third embodiment, load generating member 18B and load detector 19B which are disposed between retainer 11B of adapter 11 and slide 15 of form roller support 12, but there is provided neither the load generating member nor the load detector between retainer 11A and slide 15. Apparatus 200 of the third embodiment can be suitably utilized under condition that the rotation speed of tool holder 10 is larger than reference rotation speed Vs and centrifugal force Fb is always larger than reference press contact load Fa. By omitting first load generating member 18A, the construction of apparatus 200 of this embodiment can be further simplified than that of apparatus 1 of the first embodiment.

Referring to FIG. 6, a fourth embodiment of the apparatus of the present invention is explained, which differs from the first embodiment in that first and second load generating members 18A and 18B and first and second load detectors 19A and 19B of the first embodiment are omitted. Like reference numerals denote like parts, and therefore, detailed explanations therefor are omitted.

As illustrated in FIG. 6, in apparatus 300 of the fourth embodiment, there is provided no load generating member and load detector between retainers 11A, 11B of adapter 11 and slide 15 of form roller support 12. In apparatus 300, form roller 13 is pressed against the circumferential surface of cylinder bore B by using not load generating members but centrifugal force Fb that is exerted on form roller support 12 and form roller 13 during rotation of tool holder 10. That is, the rotation speed of tool holder 10 is controlled to generate centrifugal force Fb that is always equal to reference press contact load Fa of form roller 13, i.e., the press contact load of the predetermined value. In a method of forming microscopic recesses on the circumferential surface of cylinder bore B by using apparatus 300, the step of placing tool holder 10 and cylinder block B in the relative position, the step of moving form roller support 12 to the offset position, the step of rotating tool holder 10 are conducted in the same manner as explained in the first embodiment subsequently, while placing form roller support 12 in the offset position, a rotation speed of tool holder 10 is controlled such that the outer peripheral surface of form roller 13 is pressed against the circumferential surface of cylinder bore B at the press contact load of the predetermined value based on the centrifugal force that is exerted on form roller support 12 and form roller 13 during rotation of tool holder 10. Form roller 13 is allowed to roll on the circumferential surface of cylinder bore B, to thereby form the microscopic recesses on the circumferential surface of cylinder bore B. Apparatus 300 can be further simplified in construction than apparatus 1 of the first embodiment which uses first and second load generating members 18A, 18B and first and second load detectors 19A and 19B.

Referring to FIG. 7, a fifth embodiment of the apparatus of the present invention is explained, which differs from the first embodiment in that the adapter is omitted and a counterweight for adjusting rotation balance of the tool holder is provided. Like reference numerals denote like parts, and therefore, detailed explanations therefor are omitted.

Similar to apparatus 1 of the first embodiment, apparatus 400 of the fifth embodiment includes main shaft head 2, main shaft 3 and support platform 4 as shown in FIG. 2. Apparatus 400 further includes tool holder 110 that is disposed so as to be coaxial with main shaft 3 and rotatable about a rotation axis together therewith. Tool holder 110 is detachably mounted to main shaft 3 by using an automatic tool interchange device, not shown.

As illustrated in FIG. 7, apparatus 400 further includes lower and upper tables 111 and 114 which are moveable in the radial direction of tool holder 110, namely, in the direction perpendicular to rotation axis L1 of tool holder 110. Form roller support 12 is fixed to a lower side of lower table 111. Counterweight 116 for adjusting rotation balance of tool holder 110 is secured on upper table 114. Lower table 111 and upper table 114 are spaced from each other in the vertical direction and connected with each other through gear 115. Gear 115 is interposed between lower and upper tables 111 and 114 in engagement therewith. Lower table 111 and upper table 114 are moveable relative to each other in opposite directions perpendicular to rotation axis L1 of tool holder 110 through gear 115. Gear thus allows form roller support 12 and counterweight 116 to move in the opposite directions perpendicular to rotation axis L1 of tool holder 110. Lower table 111, upper table 114 and gear 115 form an association mechanism for moving counterweight 116 and form roller support 12 in association with each other in the opposite directions perpendicular to rotation axis L1 of tool holder 110. Lower table 111 and upper table 114 are mounted to tool-holder 110 through horizontal guides 117, 117 as shown in FIG. 8. Lower table 111 and upper table 114 are smoothly guided by horizontal guides 117, 117 in a horizontal direction, namely, in the direction perpendicular to rotation axis L1 of tool holder 10.

Counterweight 116 is provided with built-in hydraulic cylinder 116A. Hydraulic cylinder 116A serves as a drive that drives form roller support 12 to move in the direction perpendicular to rotation axis L1 of tool holder 110 via the association mechanism and drives counterweight 116 to move toward an opposite side of form roller support 12 and form roller 13 with respect to rotation axis L1 of tool holder 110. Counterweight 116 is moveable along guides 117, 117 in opposite directions perpendicular to rotation axis L1 of tool holder 110. Specifically, upper table 114 is driven by hydraulic cylinder 118 so as to reciprocatively move along guide 117 in a direction perpendicular to rotation axis L1 of tool holder 110. In association with the movement of upper table 114 in the direction perpendicular to rotation axis L1 of tool holder 110, lower table 111 is moved along guide 117 in a direction opposite to the direction of the movement of upper table 114 through gear 115. Thus, lower table 111 and upper table 114 are moveable in the opposite directions perpendicular to rotation axis L1 of tool holder 110 through gear 115. Hydraulic cylinder 116A also serves as a load generating member generating a load which is applied to form roller support 12 in a direction of advance of form roller 13 with respect to the circumferential surface of cylinder bore B. Hydraulic cylinder 116A is electronically connected to a control unit which controls an operation of hydraulic cylinder 116A as well as the operations of main shaft head 2, main shaft 3 and support platform 4. With the provision of hydraulic cylinder 116A in counterweight 116, apparatus 400 of this embodiment can be downsized and structurally simplified.

A method of forming microscopic recesses on the circumferential surface that defines cylinder bore B of cylinder block CB by using apparatus 400 of this embodiment will be explained hereinafter. First, cylinder block CB is set on support platform 4 such that rotation axis L1 of tool holder 110 and central axis L3 of cylinder bore B are in alignment with each other. Subsequently, hydraulic cylinder 116A in counterweight 116 is actuated to move upper table 114 and thereby drive form roller support 12 until form roller 13 is positioned within cylinder bore B when viewed in a direction of central axis L3 of cylinder bore B. Tool holder 110 is then driven by main shaft 3 to rotate at a preset rotation speed.

Next, tool holder 110 is driven by main shaft head 2 to enter into cylinder bore B. Tool holder 110 is moved downwardly in a direction along central axis L3 of cylinder bore B until form roller 13 has reached a predetermined position relative to the circumferential surface of cylinder bore B in which the outer peripheral surface of form roller 13 is opposed to the circumferential surface of cylinder bore B and spaced therefrom in the direction perpendicular to rotation axis L1 of tool holder 110.

Subsequently, as illustrated in FIG. 9, hydraulic cylinder 116A in counterweight 116 is actuated to move counterweight 116 together with upper table 114 in a direction perpendicular to rotation axis L1 of tool holder 110 and move form roller support 12 in a direction opposite to the direction of movement of counterweight 116 via lower table 111 and gear 115 associated with upper table 114. Counterweight 116 is thus moved toward an opposite side of form roller support 12 and form roller 13 with respect to rotation axis L1 of tool holder 110, and placed in a balanced position in which rotation balance of tool holder 110 is attainable. On the other hand, form roller support 12 is moved to an offset position in which rotation axis L2 of form roller 13 is offset from rotation axis L1 of tool holder 110. Then, while rotating tool holder 110 about rotation axis L1, form roller support 12 is controlled such that and the outer peripheral surface of form roller 13 is pressed against the circumferential surface of cylinder bore B at a press contact load of a predetermined value at which the microscopic recesses having desired size and depth can be formed on the circumferential surface of cylinder bore B. The press contact load of the predetermined value is substantially equal to an entire load generated by hydraulic cylinder 116A. In this condition, form roller 13 is allowed to rotate about rotation axis L2, and at the same time, roll on the circumferential surface of cylinder bore B. As a result, the microscopic recesses are formed on the circumferential surface of cylinder bore B. It is preferred that the rotating movement of main shaft 3 and the downward-axial movement of main shaft head 2 are synchronized with each other. In such a case, the microscopic recesses can be continuously formed on the circumferential surface of cylinder bore B along a spiral trail of form roller 13. The microscopic recesses can be efficiently formed over a wide area of the circumferential surface of cylinder bore B.

In apparatus 400 of the fifth embodiment as explained above, counterweight 116 and form roller support 12 with form roller 13 are moved in the opposite directions perpendicular to rotation axis L1 of tool holder 110 to each other, whereby an amount of rotation unbalance of tool holder can be eliminated. Accordingly, substantially the entire load generated by hydraulic cylinder 116A can act as the press contact load at which form roller 13 is pressed against the circumferential surface of cylinder bore B. This serves for precisely controlling the press contact load to thereby form the microscopic recesses on the circumferential surface of cylinder bore B with enhanced accuracy.

Further, apparatus 400 of the fifth embodiment and the method of forming the microscopic recesses by using apparatus 400 can provide microscopic recesses on the circumferential surface of cylinder bore B of cylinder block CB with high efficiency and high accuracy. Further, even when the microscopic recesses are formed with a small contact load, tool holder 110 can be rotated at high speed. This serves for enhancing the working efficiency upon formation of the microscopic recesses and remarkably reducing the production cost. Further, in apparatus 400, form roller 13 can be in press contact with the circumferential surface of cylinder bore B at the press contact load of the predetermined value. Therefore, it is possible to omit previous works for the circumferential surface of cylinder bore B which must be conventionally performed with high accuracy before forming the microscopic recesses thereon. This realizes significant reduction in the number of production steps and the production cost.

Further, by moving counterweight 116 and form roller support 12 with form roller 13 in the opposite directions perpendicular to rotation axis L1 of tool holder 110 to each other, influence of the centrifugal force that is exerted on form roller support 12 and form roller 13 during rotation of tool holder 110 can be cancelled. Therefore, even when tool holder 110 is rotated at high speed, the microscopic recesses having uniform depth and size can be formed with a relatively small contact load, and working efficiency upon formation of the microscopic recesses can be further enhanced. In addition, apparatus 400 is simplified in construction and downsized to thereby be useable for forming microscopic recesses on a circumferential surface of the cylinder bore that has a relatively small diameter.

Further, by relatively moving cylinder block CB and tool holder 110 in the direction along central axis L3 of cylinder bore B, the microscopic recesses can be formed in a wide area of the circumferential surface of cylinder bore B which extends along central axis L3 of cylinder bore B. Further, by driving form roller support 12 to move in the direction perpendicular to rotation axis L1 of tool holder 110, the position of form roller 13 with respect to the circumferential surface of cylinder bore B can be desirably varied. Further, the operation of relatively moving cylinder block CB and tool holder 110 can be simultaneously conducted with the operation of driving tool holder 110. This serves for saving the working time and increasing the working efficiency.

Further, since apparatus 400 of the fifth embodiment includes hydraulic cylinder 116A which serves as the load generating member for form roller support 12 and the drive for driving counterweight 116 and form roller support 12, apparatus 400 can be used for cylinder bores different in diameter from each other. FIG. 10 shows apparatus 400 which is used upon forming microscopic recesses on the circumferential surface of cylinder bore B having a diameter smaller than that of cylinder bore B shown in FIG. 9. Further, it is possible to form the microscopic recesses such that size and depth thereof are varied in different areas of the circumferential surface of cylinder bore B by controlling the press contact load during pressing form roller 13 against the circumferential surface of cylinder bore B.

Further, the microscopic recesses are regularly arranged on the circumferential surface of cylinder bore B by using apparatus 400 of the fifth embodiment and therefore effectively act as oil retention portions. With the provision of the microscopic recesses, the circumferential surface of cylinder bore B of cylinder block CB can show reduced friction that will occur upon undergoing sliding contact with a piston, serving for enhancing an engine output.

Referring to FIGS. 11 and 12, a sixth embodiment of the apparatus of the present invention is explained, which differs from the fifth embodiment in that a spring is used as the load generating member and a motor is used as the drive for the form roller support, instead of the hydraulic cylinder built in the counterweight. Like reference numerals denote like parts, and therefore, detailed explanations therefor are omitted.

As illustrated in FIG. 11, apparatus 500 of the sixth embodiment includes spring 119 that serves as the load generating member for form roller support 12, and motor 120 that serves as the drive for form roller support 12. Motor 120 also serves as the counterweight for adjusting rotation balance of tool holder 110. Motor 120 is secured to upper table 114 and reciprocatively moveable along guides 117, 117 in the direction perpendicular to rotation axis L1 of tool holder 10.

In this embodiment, spring 119 is a compression coil spring. Spring 119 is disposed between motor 120 and a side wall of tool holder 110 so as to generate a load which is applied to form roller support 12 in a direction of advance of form roller 13 with respect to the circumferential surface of cylinder bore B. Specifically, spring 119 generates a spring force that acts as a load which is applied to form roller support 12 through motor 120, upper and lower tables 114 and 111 and gear 115 such that form roller 13 is advanced toward the circumferential surface of cylinder bore B in the direction perpendicular to rotation axis L1 of tool holder 10. Apparatus 500 further includes load detector 123 that detects the load generated by spring 119. In this embodiment, a load cell is used as load detector 123. Load detector 123 is fixed to adapter 124 that is rotatably disposed on the side wall of tool holder 110. The load which is applied to form roller support 12 can be varied by rotating adapter 124. The load which is applied to form roller support 12 may be changed by replacing spring 119. Load detector 123 is electronically connected to a control unit. The control unit receives a detection signal transmitted from load detector 123 and controls operations of main shaft head 2, main shaft 3, support platform 4 and motor 120.

A method of forming microscopic recesses on the circumferential surface that defines cylinder bore B of cylinder block CB by using apparatus 500 of the sixth embodiment is similar to the method using apparatus 400 of the fifth embodiment except that motor 120 is operated to drive form roller support 12 instead of hydraulic cylinder 116A. Specifically, after placing cylinder block CB on support platform 4 such that tool holder 110 and cylinder bore B are coaxially arranged, motor 120 is operated to move upper table 114 and thereby move form roller support 12 until form roller 13 is positioned within cylinder bore B when viewed in a direction of central axis L3 of cylinder bore B. Tool holder 110 is then driven by main shaft 3 to rotate at a preset rotation speed.

Next, tool holder 110 is driven to downwardly move in a direction along central axis L3 of cylinder bore B until form roller 13 has reached the predetermined position relative to the circumferential surface of cylinder bore B in which the outer peripheral surface of form roller 13 is opposed to the circumferential surface of cylinder bore B and spaced therefrom in the direction perpendicular to rotation axis L1 of tool holder 110.

Subsequently, motor 120 is operated to move together with upper table 114 against the spring force of spring 119 in a direction perpendicular to rotation axis L1 of tool holder 110 and move form roller support 12 in a direction opposite to the direction of movement of motor 120 via lower table 111 and gear 115 associated with upper table 114. Motor 120 serving as the rotation balance counterweight is thus moved toward an opposite side of form roller support 12 and form roller 13 with respect to rotation axis L1 of tool holder 110 and placed in a balanced position in which rotation balance of tool holder 110 is attainable. On the other hand, form roller support 12 is moved to an offset position in which rotation axis L2 of form roller 13 is offset from rotation axis L1 of tool holder 110. Then, while rotating tool holder 110 about rotation axis L1, form roller support 12 is controlled such that the outer peripheral surface of form roller 13 is pressed against the circumferential surface of cylinder bore B at a press contact load of a predetermined value at which the microscopic recesses having desired size and depth can be formed on the circumferential surface of cylinder bore B. As a result, form roller 13 is allowed to rotate about rotation axis L2 thereof and roll on the circumferential surface of cylinder bore B to thereby form the microscopic recesses on the circumferential surface of cylinder bore B. The rotating movement of main shaft 3 and the downward-axial movement of main shaft head 2 may be synchronized with each other. In such a case, the microscopic recesses can be continuously formed on the circumferential surface of cylinder bore B along a spiral trail of form roller 13 and can be efficiently formed over a wide area of the circumferential surface of cylinder bore B.

Apparatus 500 of the sixth embodiment can perform substantially the same functions and effects as those of apparatus 400 of the fifth embodiment. In addition, by using spring 119 as the load generating member in apparatus 500, even when cylinder bore B of cylinder block CB has an error in roundness or cylindricity, form roller 13 can be smoothly rolled on the circumferential surface of cylinder bore B to thereby readily form microscopic recesses having uniform depth and size on the circumferential surface of cylinder bore B. Further, by using spring 119 as the load generating member in apparatus 500, piping for a hydraulically or pneumatically operated load generating member can be omitted. This serves for simplifying the construction of apparatus 500.

Referring to FIG. 13, a seventh embodiment of the apparatus of the present invention is explained, which differs from the fifth embodiment in that an unbalance detector that detects at least one of an amount of rotation unbalance of the tool holder and a direction of rotation unbalance of the tool holder is provided. Like reference numerals denote like parts, and therefore, detailed explanations therefor are omitted.

As illustrated in FIG. 13, apparatus 600 of the seventh embodiment includes oscillation sensor 130 and rotation sensor 132 which are provided on main shaft head 2. Oscillation sensor 130 detects oscillation which is caused in main shaft head 2 upon rotation of main shaft 3. Rotation sensor 132 detects a rotational phase of main shaft 3. With the provision of oscillation sensor 130 and rotation sensor 132, an amount of rotation unbalance which occurs in tool holder 110 during the rotation and a direction of the rotation unbalance can be detected. On the basis of the amount of the rotation unbalance detected and the direction of the rotation unbalance detected, hydraulic cylinder 116A is operated to adjust the position of counterweight 116 in the direction perpendicular to rotation axis L1 of tool holder 110. As a result, the amount of the rotation unbalance can be reduced, serving for forming the microscopic recesses with enhanced accuracy. An acceleration sensor or speed sensor may be used instead of oscillation sensor 130.

The apparatus and method of the present invention is not limited to the above-described embodiments and may be suitably modified in various ways. Further, the apparatus and method of the present invention may be used for formation of microscopic recesses on a circumferential surface that defines a cylindrical bore of various kinds of members as a workpiece, without being limited to the cylinder block and the cylindrical member of the above-described embodiments. For instance, the apparatus and method of the present invention may be used for formation of microscopic recesses on a circumferential surface that defines a cylinder bore of a compressor, and on a bearing surface that defines a cylindrical bore of a sliding bearing. Further, after the formation of microscopic recesses is completed, the circumferential surface may be subjected to a suitable removal step such as honing to thereby remove protrudent peripheral portions which are formed around the microscopic recesses. This removal step is effective to further enhance quality of the circumferential surface of the cylindrical bore of the workpiece.

This application is based on prior Japanese Patent Application No. 2005-197377 filed on Jul. 6, 2005, Japanese Patent Application No. 2006-122831 filed on Apr. 27, 2006, and Japanese Patent Application No. 2006-169080 filed on Jun. 19, 2006. The entire contents of the Japanese Patent Application Nos. 2005-197377, 2006-122831 and 2006-169080 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An apparatus for forming recesses on a circumferential surface that defines a cylindrical bore in a workpiece, the apparatus comprising:

a tool holder disposed coaxially with the cylindrical bore and rotatably about a rotation axis;

a form roller support retained on the tool holder, the form roller support being moveable in a direction perpendicular to the rotation axis of the tool holder;

a form roller rotatably supported on the form roller support so as to be rotatable about a rotation axis that is parallel to the rotation axis of the tool holder, the form roller comprising projections on an outer circumferential surface thereof which are configured to form the recesses on the circumferential surface that defines the cylindrical bore in the workpiece; and a control assembly configured to control the form roller support such that the form roller is allowed to be in press contact with the circumferential surface that defines the cylindrical bore in the workpiece at a press contact load of a predetermined value on the basis of a centrifugal force which is exerted on the form roller support and the form roller during rotation of the tool holder.

2. The apparatus as claimed in claim 1, further comprising at least one of a first load generating member that generates a load which is applied to the form roller support in a direction of advance of the form roller with respect to the circumferential surface that defines the cylindrical bore, and a second load generating member that generates a load which is applied to the form roller support in a direction of retreat of the form roller with respect to the circumferential surface that defines the cylindrical bore.

3. The apparatus as claimed in claim 1, wherein the control assembly comprises a radial movement member moveable in a direction perpendicular to the rotation axis of the tool holder, wherein the form roller support is retained by the radial movement member.

4. The apparatus as claimed in claim 2, wherein the control assembly comprises a radial movement member moveable in a direction perpendicular to the rotation axis of the tool holder, wherein the form roller support is retained by the radial movement member.

5. The apparatus as claimed in claim 1, further comprising an axial movement member that causes a relative axial movement of the workpiece and the tool holder in a direction along a central axis of the cylindrical bore.

6. An apparatus for forming recesses on a circumferential surface that defines a cylindrical bore in a workpiece, the apparatus comprising:

a tool holder disposed coaxially with the cylindrical bore and rotatably about a rotation axis;

a form roller support retained on the tool holder, the form roller support being moveable in a direction perpendicular to the rotation axis of the tool holder;

a form roller rotatably supported on the form roller support so as to be rotatable about a rotation axis that is parallel to the rotation axis of the tool holder, the form roller comprising projections on an outer circumferential surface thereof which are configured to form recesses on the circumferential surface that defines the cylindrical bore in the workpiece;

a control assembly configured to control the form roller support such that the form roller is allowed to be in press contact with the circumferential surface that defines the cylindrical bore in the workpiece at a press contact load of a predetermined value on the basis of a centrifugal force which is exerted on the form roller sue sort and the form roller during rotation of the tool holder; and at least one of a first load generating member that generates a load which is applied to the form roller support in a direction of advance of the form roller with respect to the circumferential surface that defines the cylindrical bore, and a second load generating member that generates a load which is applied to the form roller support in a direction of retreat of the form roller with respect to the circumferential surface that defines the cylindrical bore, wherein the control assembly comprises a radial movement member moveable in a direction perpendicular to the rotation axis of the tool holder, wherein the form roller support is retained by the radial movement member, and wherein the first load generating member is a spring disposed between the radial movement member and the form roller support.

7. The apparatus as claimed in claim 6, wherein the second load generating member is a spring disposed between the radial movement member and the form roller support.

8. The apparatus as claimed in claim 2, wherein the at least one of the first load generating member and the second load generating member is an actuator that is expandable in the direction perpendicular to the rotation axis of the tool holder.

9. The apparatus as claimed in claim 1, further comprising a rotation speed detector that detects a rotation speed of the tool holder.

10. The apparatus as claimed in claim 9, wherein the rotation speed detector is a rotary encoder.

11. The apparatus as claimed in claim 2, further comprising a load detector that detects a load generated by the at least one of the first load generating member and the second load generating member.

12. The apparatus as claimed in claim 11, wherein the load detector is a load cell.

13. The apparatus as claimed in claim 1, further comprising a load generating member that generates a load which is applied to the form roller support in a direction of advance of the form roller with respect to the circumferential surface that defines the cylindrical bore.

14. The apparatus as claimed in claim 1, wherein the control assembly comprises a counterweight for adjusting rotation balance of the tool holder, the counterweight being moveable in opposite directions perpendicular to the rotation axis of the tool holder.

15. The apparatus as claimed in claim 13, wherein the load generating member is an actuator that is expandable in a direction perpendicular to the rotation axis of the tool holder and opposite to the direction of movement of the form roller support.

16. The apparatus as claimed in claim 14, wherein the control assembly further comprises a drive that drives the form roller support to move in the direction perpendicular to the rotation axis of the tool holder and drives the counterweight to move in a direction opposite to the direction of movement of the form roller support.

17. The apparatus as claimed in claim 14, wherein the control assembly further comprises an association mechanism for moving the counterweight and the form roller support in association with each other.

18. The apparatus as claimed in claim 14, further comprising a guide that guides the form roller support and the counterweight, respectively.

19. An apparatus for forming recesses on a circumferential surface that defines a cylindrical bore in a workpiece, the apparatus comprising:

a tool holder disposed coaxially with the cylindrical bore and rotatably about a rotation axis;

a form roller support retained on the tool holder, the form roller support being moveable in a direction perpendicular to the rotation axis of the tool holder;

a form roller rotatably supported on the form roller support so as to be rotatable about a rotation axis that is parallel to the rotation axis of the tool holder, the form roller comprising projections on an outer circumferential surface thereof which are configured to form recesses on the circumferential surface that defines the cylindrical bore in the workpiece;

a control assembly configured to control the form roller support such that the form roller is allowed to be in press contact with the circumferential surface that defines the cylindrical bore in the workpiece at a press contact load of a predetermined value on the basis of a centrifugal force which is exerted on the form roller support and the form roller during rotation of the tool holder; and a load generating member that generates a load which is a lied to the form roller support in a direction of advance of the form roller with respect to the circumferential surface that defines the cylindrical bore, wherein the load generating member is a spring.

20. The apparatus as claimed in claim 14, wherein the counterweight is a motor.

21. The apparatus as claimed in claim 1, wherein the control assembly comprises a motor that drives the form roller support to move in the direction perpendicular to the rotation axis of the tool holder.

22. The apparatus as claimed in claim 21, wherein the control assembly further comprises an association mechanism for moving the motor and the form roller support in association with each other.

23. The apparatus as claimed in claim 21, further comprising a guide that guides the motor.

24. The apparatus as claimed in claim 13, further comprising a load detector that detects a load generated by the load generating member.

25. The apparatus as claimed in claim 24, wherein the load detector is a load cell.

26. The apparatus as claimed in claim 14, further comprising an unbalance detector that detects at least one of an amount of rotation unbalance of the tool holder and a direction of rotation unbalance of the tool holder.

27. The apparatus as claimed in claim 1, wherein the projections are microscopic projections.

28. The apparatus as claimed in claim 6, wherein the projections are microscopic projections.

29. The apparatus as claimed in claim 19, wherein the projections are microscopic projections.

30. An apparatus for forming microscopic recesses on a circumferential surface that defines a cylindrical bore in a workpiece, the apparatus comprising:

a tool holder disposed coaxially with the cylindrical bore and rotatably about a first rotation axis;

a form roller support retained on the tool holder, the form roller support being moveable in a direction perpendicular to the first rotation axis;

a form roller rotatably supported on the form roller support so as to be rotatably about a second rotation axis that is offset from and extends parallel to the first rotation axis, the form roller comprising microscopic projections on an outer circumferential surface thereof which are configured to form the microscopic recesses; and a control assembly configured to control the relative position of the form roller support to the tool holder such that the form roller is allowed to be maintained in press contact with the circumferential surface at a predetermined press contact load to compensate for a centrifugal force exerted on the form roller during rotation of the tool holder.

* * * * *